US009694414B2

(12) United States Patent
Ehrmann et al.

(10) Patent No.: US 9,694,414 B2
(45) Date of Patent: Jul. 4, 2017

(54) DEEP-DRAWING PACKAGING MACHINE WITH ELECTROMOTIVE LIFTING GEAR

(71) Applicant: Multivac Sepp Haggenmüller GmbH & Co. KG, Wolfertschwenden (DE)

(72) Inventors: Elmar Ehrmann, Bad Grönenbach (DE); Klaus Weiss, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 689 days.

(21) Appl. No.: 14/108,929

(22) Filed: Dec. 17, 2013

(65) Prior Publication Data

US 2014/0169915 A1 Jun. 19, 2014

(30) Foreign Application Priority Data

Dec. 19, 2012 (EP) ..... 12008459

(51) Int. Cl.

| | |
|---|---|
| ***B21D 51/18*** | (2006.01) |
| ***B65B 31/02*** | (2006.01) |
| ***B65B 65/02*** | (2006.01) |
| ***B65B 7/16*** | (2006.01) |
| *B65B 47/00* | (2006.01) |
| *B65B 61/06* | (2006.01) |

(52) U.S. Cl.

CPC ..... *B21D 51/18* (2013.01); *B65B 7/164* (2013.01); *B65B 31/021* (2013.01); *B65B 31/028* (2013.01); *B65B 65/02* (2013.01); *B65B 47/00* (2013.01); *B65B 61/06* (2013.01); *B65B 61/065* (2013.01)

(58) Field of Classification Search

CPC B65B 9/04; B65B 11/50; B65B 11/52; B65B 47/00; B65B 47/02; B65B 47/04; B65B 47/08; B65B 47/10; B65B 65/00; B65B 65/02; B65B 31/021; B65B 31/028; B65B 61/06; B65B 61/065; B65B 7/164; B21D 51/18; B29C 51/38; B29C 51/08–51/087; B29C 33/22; B29C 51/20

USPC ..... 53/559, 561, 282, 329.2–329.5; 425/450.1; 413/69

See application file for complete search history.

(56) References Cited

U.S. PATENT DOCUMENTS 3,071,812 A * 1/1963 Miller ..... B29C 51/225 425/292
4,629,853 A * 12/1986 Yttergren ..... B23K 9/032 219/124.03
4,698,007 A * 10/1987 Hehl ..... B29C 45/1756 100/918

(Continued)

FOREIGN PATENT DOCUMENTS

CN 1174801 A 3/1998
CN 1323719 A 11/2001

(Continued)

*Primary Examiner* — Hemant M Desai
*Assistant Examiner* — Valentin Neacsu
(74) *Attorney, Agent, or Firm* — Husch Blackwell LLP

(57) ABSTRACT

The invention relates to a deep-drawing packaging machine with a lifting gear for a forming station, sealing station or cutting station, wherein the lifting gear provides guides and lifting spindles which are arranged outside a collision region of a movable tool.

15 Claims, 4 Drawing Sheets

(56) References Cited

U.S. PATENT DOCUMENTS

| | | | | | |
|---|---|---|---|---|---|
| 4,710,121 | A * | 12/1987 | Hehl | B29C 45/1756 | 425/190 |
| 5,205,110 | A | 4/1993 | Buchko | | |
| 5,662,316 | A * | 9/1997 | Schaldach | B23Q 1/0018 | 269/25 |
| 5,755,310 | A * | 5/1998 | Wourms | B66B 9/025 | 187/267 |
| 6,006,505 | A * | 12/1999 | Natterer | B65B 65/02 | 53/374.8 |
| 6,074,583 | A * | 6/2000 | Ingram | B29C 43/08 | 264/268 |
| 2006/0048480 | A1* | 3/2006 | Konishi | B65B 7/164 | 53/329.3 |
| 2006/0123739 | A1* | 6/2006 | Konishi | B65B 7/164 | 53/329.3 |
| 2009/0241485 | A1* | 10/2009 | Buchko | B29C 51/04 | 53/543 |
| 2009/0260320 | A1* | 10/2009 | Miller | B65B 31/024 | 53/94 |
| 2009/0288365 | A1* | 11/2009 | Negele | B65B 31/028 | 53/329 |
| 2010/0051885 | A1* | 3/2010 | Davis | B66F 7/14 | 254/92 |
| 2013/0126298 | A1* | 5/2013 | Junk | B65B 43/52 | 198/339.1 |

FOREIGN PATENT DOCUMENTS

| | | | | |
|---|---|---|---|---|
| CN | 102803075 | A | 11/2012 | |
| DE | 8623122 | U1 | 1/1987 | |
| DE | 4216210 | A1 | 11/1993 | |
| DE | 19920260 | A1 | 11/2000 | |
| DE | 102008023319 | A1 | 11/2009 | |
| DE | 102008053665 | A1 | 5/2010 | |
| DE | 102009044120 | A1 * | 3/2011 | B29C 65/18 |
| EP | 0483446 | A1 | 5/1992 | |
| EP | 2527262 | A1 | 11/2012 | |

* cited by examiner

DEEP-DRAWING PACKAGING MACHINE WITH ELECTROMOTIVE LIFTING GEAR

CROSS-REFERENCE TO RELATED APPLICATIONS

This Application claims priority to European Application Number 12008459.5 filed Dec. 19, 2012, to Elmar Ehrmann and Klaus Weiss entitled "Deep-Drawing Packaging Machine with Electromotive Lifting Gear," currently pending, the entire disclosure of which is incorporated herein by reference.

FIELD OF THE INVENTION

The invention relates to a deep-drawing packaging machine

BACKGROUND OF THE INVENTION

From DE 42 16 210 A1, a pneumatic knuckle joint lifting gear for a deep-drawing packaging machine is known in which all drive components and the knuckle joint mechanism are disposed underneath the movable tool. In deep-drawing packaging machines, the working height or the subfilm transport level is located at a height of approximately 900 mm above ground. With such a working height and a knuckle joint lifting gear, cavities of a maximum drawing depth of about 200 mm may be manufactured.

From U.S. Pat. No. 5,205,110, an electromotive lifting gear for a deep-drawing packaging machine is known in which an electric motor is disposed in the production direction downstream of a forming station and outside the travel of a mould bottom part, and the mould bottom part is lifted and lowered by means of the lifting gear. The drive energy of the electric motor is transmitted to a connecting rod by means of drive belts, the connecting rod in turn converting its rotary motion into a vertical motion of the mould bottom part by means of a connecting link guide. In the process, the connecting rod is moved into a dead center position where the mould bottom part is located in its working position to be able to take up high closure forces in cooperation with the die top.

From DE 10 2008 023 319 A1, a lifting gear for a tray sealer is known wherein the lifting gear comprises two spindles which are driven via a sprocket belt by a servomotor. All drive and transmission components are disposed underneath the sealing tool bottom.

Lifting gears of the known prior art have the disadvantage that by the arrangement of drive components underneath a tool to be moved vertically, the travel of the latter is very restricted, or that the tool to be moved may not be held in any position such that it is able to take up closure forces in the form of retention forces occurring with the cooperating upper tool.

SUMMARY OF THE INVENTION

It is the object of the present invention to provide an electromotive lifting gear for a deep-drawing packaging machine with a longer travel and a flexible positioning.

This object is achieved by a deep-drawing packaging machine, comprising an electromotive lifting gear.

The deep-drawing packaging machine according to one embodiment of the present invention comprises an electromotive lifting gear for a forming, sealing and/or cutting station, the lifting gear comprising two carriages and a tool connected to the carriage, and the carriages being mounted in vertical guides, and wherein a collision region is defined by the lifting motion of the tool between a lower and an upper position. The collision region may, in one instance, be more precisely defined as the integral of all positions in space the tool may assume or pass over in a motion from the lower to the upper position (or vice-versa). The invention is characterized in that the lifting gear can comprise at least two lifting spindles which are arranged parallel to the guides and, in a plan view, outside the collision region of the tool. Thus, the transmission components, such as a knuckle joint lifting gear, underneath the tool may be eliminated, and the travel may be extended to the bottom with respect to the ground surface without lifting the working height of the deep-drawing packaging machine thereby.

The lifting spindles may be thread rolling spindles or trapezoidal thread spindles, for example with a pitch of 10 mm per rotation to permit on the one hand a high adjustment speed, and on the other hand a high lifting force or retention force.

The lifting spindles can be covered by telescopic springs to meet high demands on hygiene, for example in the medical or food field, as some machine parts are cleaned with cleansing agents and this kind of complete cover for movable machine parts thus offers optimum protection.

The lifting gear can comprise brakes which lock the lifting spindles to permit high retention forces acting from an upper tool part onto the moveable tool by the occurring and required closure forces. For example, the upper mould part and the lower mould part must pinch the film all around at the forming station and withstand a high mould pressure of up to 6 bar. The high own weight of the movable lower mould part is also relevant.

In one embodiment, the lifting spindles may be driven via a belt drive by means of an electric motor. In this case, the electric motor can be a servomotor to permit both high adjustment speeds and a high positioning accuracy of the tool. This embodiment permits a very flat design and thus requires only little space underneath the movable tool. The high positioning accuracy also permits the processing of different film thicknesses since the torque and thus the retention force of the movable tool may be adapted in any position, whereby even minor differences in the thickness of the film of below 50 μm may be compensated.

The belt drive may comprise a sprocket belt to transmit the torque of the electric motor to the lifting spindles, the lifting spindles thus being also synchronized with respect to each other.

In one embodiment, the lifting gear comprises a fixed and a movable connection unit for external media, for example for vacuum or exhaust air. The advantage is a stationary supply line of media to the fixed connection unit, so that these lines are not subjected to any motions. The movable connection unit can be attached to the lifting rail or to the tool and cooperates with the fixed connection unit in an upper working position in which the movable tool also cooperates with a stationary upper tool part of the respective workstation. Both the tools and the connection units are here each sealed together in an air-tight manner.

The fixed connection unit may be attached to the lifting gear such that it cooperates with the movable connection unit in the working position of the tool to connect a medium with the tool by means of both connection units. Thus, none of the media lines is subjected to any motion which would affect the service life of the line.

The connection units may each have a contact surface inclined with respect to the moving direction of the lifting direction of the lifting gear, permitting a short structural shape of the connection units in the production direction with a contact surface oriented perpendicularly to the lifting motion.

The lifting gear can have a travel of more than 300 mm in one embodiment, and, in particular more than 400 mm in another embodiment.

It is suitable for the movable tool to not only be positionable in an upper and lower position, but additionally in a tool change position. In this position, the tool may be particularly easily accessible which improves the handling of the packaging machine in particular with respect to a tool change.

The lifting spindles can each be provided between two guides disposed adjacently in a production direction to permit a uniform distribution of the lifting forces and retention forces and minimize transverse forces on the guides.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Equal components are always provided with the same reference numerals in the figures.

DETAILED DESCRIPTION OF THE INVENTION

Figure 1:
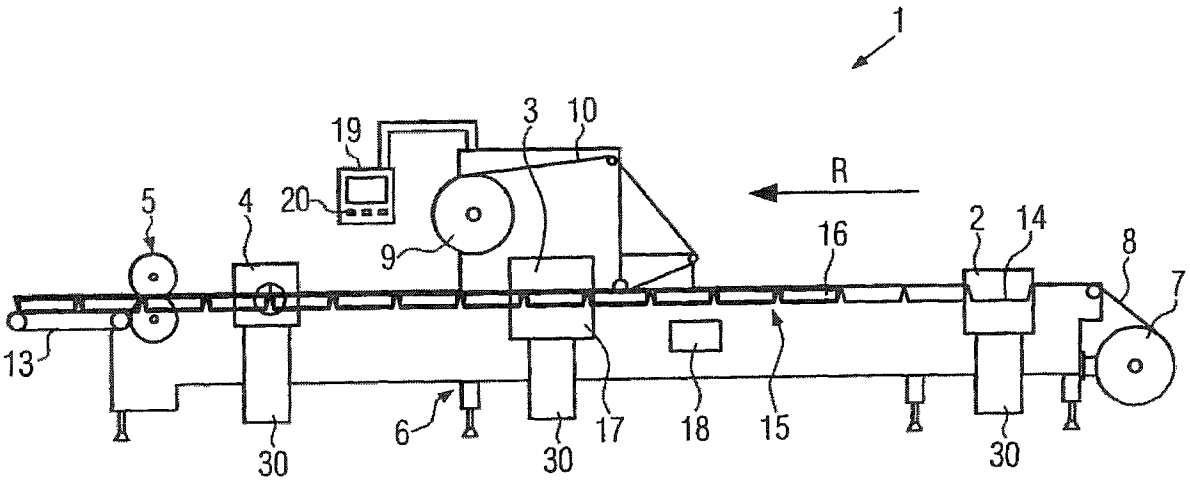
FIG. 1 is a schematic side view of a deep-drawing packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 in a schematic view shows a deep-drawing packaging machine 1 according to one embodiment of the present invention. In this embodiment, the deep-drawing packaging machine 1 comprises a forming station 2, a sealing station 3, a cross cutter 4 and a longitudinal cutter 5 which are arranged at a machine frame 6 in this sequence in a production direction R. On the entry side, a feed roller 7 can be located at the machine frame 6, a film 8 being reeled off from said roller. In the region of the sealing station 3, a material storage 9 may be provided from which a lid film 10 is reeled off. On the exit side, a discharge apparatus 13 can be provided at the deep-drawing packaging machine in the form of a conveying belt by means of which finished, separated packages are carried away. Furthermore, the deep-drawing packaging machine 1 may comprise a non-depicted feed apparatus which grips the film 8 and transports it further in the production direction R in each main cycle. The feed apparatus may be designed, for example, by transport chains disposed on either side.

In the shown embodiment, the forming station 2 is embodied as a deep-drawing station in which cavities 14 are formed in the film 8 by deep-drawing. The forming station 2 may be designed such that several cavities are formed next to each other in the direction perpendicular to the production direction R. The forming station 2 can comprise a lifting gear 30 to move a lower mould part or a tool 32 (see FIG. 2) upwards against an upper mould part 47 into a working position for the forming process. In the production direction R downstream of the forming station 2, an insertion section 15 may be provided in which the cavities 14 formed in the film 8 are filled with products 16.

The sealing station 3 may also have a lifting gear 30 and a closable chamber 17 in which the atmosphere in the cavities 14 may be replaced, for example by evacuating or by gas flushing using a replacement gas or a gas mixture before sealing.

The cross cutter 4 can also comprise a lifting gear 30 and may be designed as a punching machine which cuts through the film 8 and the lid film 10 between adjacent cavities 14 in a direction transverse to the production direction R. In the process, the cross cutter 4 may be designed to operate such that the film 8 is not cut through across its total width, and at least a portion of the film 8 proximate the edge region is left intact. The intact portion of the film 8 permits a controlled further transport of the film 8 by the feed apparatus. The cross cutter 4 can also include a lifting gear 30.

In the shown embodiment, the longitudinal cutter 5 is designed as a knife arrangement by which the film 8 and the lid film 10 are cut through between adjacent cavities 14 and at the lateral edge of the film 8, so that separated packages are present downstream of the longitudinal cutter 5.

The deep-drawing packaging machine 1 furthermore optionally comprises a control 18. The latter has the task of controlling and monitoring the processes running in the deep-drawing packaging machine 1. A display device 19 with operational controls 20 serves to visualize or influence the process operations in the packaging machine 1 for or by an operator.

The general working manner of the packaging machine 1 will now be briefly described below.

The film 8 may be reeled off from the feed roller 7 and transported into the forming station 2 by the feed device. In the forming station 2, cavities 14 can be formed in the film 8 by deep-drawing. In a main cycle, the cavities 14 are transported further, together with the surrounding area of the film 8, to the insertion section 15 where they are filled with products 16.

Subsequently, the feed device may transport the filled cavities 14 further to the sealing station 3 in the main cycle, together with the surrounding area of the film 8. The lid film 10 can be transported further with the feed motion of the film 8 after a procedure of sealing it to the film 8. In the process, the lid film 10 may be reeled off from the material storage 9. By sealing the lid film 10 onto the cavities 14, closed packages are formed which are separated in subsequent cutting operations 4 and 5 and transported out of the deep-drawing packaging machine 1 by the discharge means 13.

Figure 2:
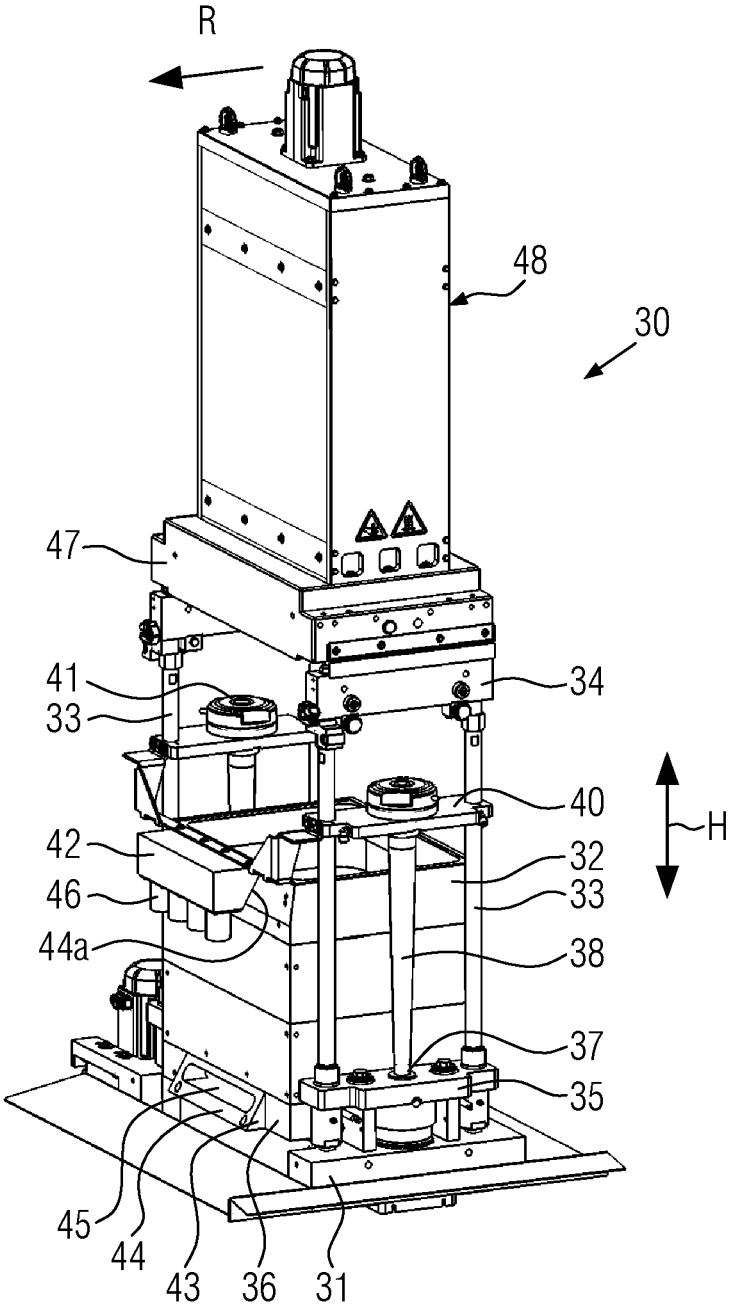
FIG. 2 is a side perspective view of a lifting gear of a forming station in an open position according to one embodiment of the present invention.
Figure 3:
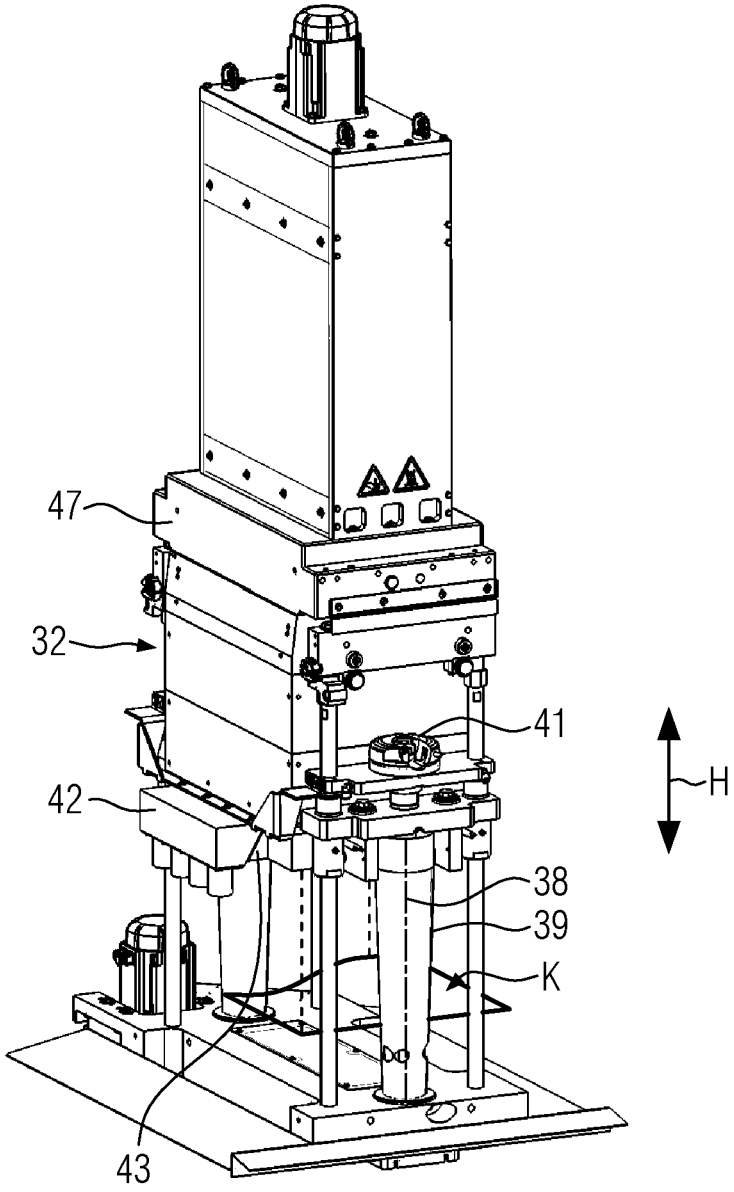
FIG. 3 is side perspective view of a lifting gear of a forming station in a closed position according to one embodiment of the present invention.

FIG. 2 shows the lifting gear 30 in an open position in which the movable tool 32 is in its lowermost position, with a console 31 at which two guides 33 are attached for both sides of the tool 32, respectively, on the right and left seen in the production direction R, the guides 33 being connected to supports 34 at their upper ends. The lifting gear 30 may be attached to the machine frame 6 in the deep-drawing packaging machine 1 by the supports 34. Each carriage 35 is movable vertically, wherein the vertical movement of each carriage 35 may be guided by two of the guides 33 (as shown), and both carriages 35 may be connected to each other via a lifting rail 36 which is oriented transversely to the production direction R. One spindle nut 37 each can be integrated at the carriage 35, the spindle nut providing for a lifting motion H of the lifting rail 36. One lifting spindle 38 can be centrically provided between each of the guides 33. The rotation of the lifting spindle 38 causes a vertical lifting motion H of the spindle nut 37 and thus of the carriage 35 or the lifting rail 36. The lifting spindle 38 may be completely covered by a telescopic spring 39 (FIG. 3 shows telescopic springy 39 covering spindle 38) between the console 31 and the carriage 35, and also between a cross strut 40 and the carriage 35. The lifting spindle 38 may be locked by a brake 41 provided at the cross strut 40.

The lifting rail 36 serves to receive the tool 32 which is designed in three parts in this exemplary embodiment and has a drawing depth of 350 mm, for example. A fixed connection unit 42 can be attached to the cross struts 40, and a movable connection unit 43 may be attached to the lifting rail 36. The movable connection unit 43 can have a contact surface 44 that is inclined by 30° to 60° with respect to the lifting motion H of the lifting gear 30 and has a through opening 45, the through opening 45 being connected to the tool 32 by passages in the lifting rail 36, which are not shown in greater detail. The inclination of the contact surface 44*a* of the fixed connection unit 42 may be provided corresponding to the lifting motion H to the inclination of the contact surface 44 of the movable connection unit 43. Medium supply or discharge lines 46, for example for vacuum or exhaust air, are attached to the fixed connection unit 42.

In the upper region of the lifting gear 30, an upper tool part 47, here in particular an upper mould part, can be arranged at the supports 34, and a servomotive die apparatus 48 with one or several dies may support the forming process for forming the cavities 14 in the film 8.

FIG. 3 shows the lifting gear 30 in the closed position where the tool 32 is in its uppermost position which is at the same time its working position. Here, the film 8 is pinched between the tool 32 and the upper tool part 47, and the two connection units 42, 43 cooperate with their contact surfaces in a sealing manner. The lifting motion H of the tool 32 and the space thus required for this motion define a collision region K. The tool 32 may also be positioned in other positions where none of the tools 32, 47 or the connection units 42, 43 cooperate. This may be, for example, a position where a change of the tool 32 may be effected in or against the production direction R or to the top. In the working position of the tool 32, the brakes 41 may be activated to lock the lifting spindles 38. So, the tool 32 may take up very high closure forces generated by the upper tool part 47 and mould pressures within the tools 32 without the pinching of the film 8 being cancelled or the tools 32, 47 no longer sealing sufficiently.

Figure 4:
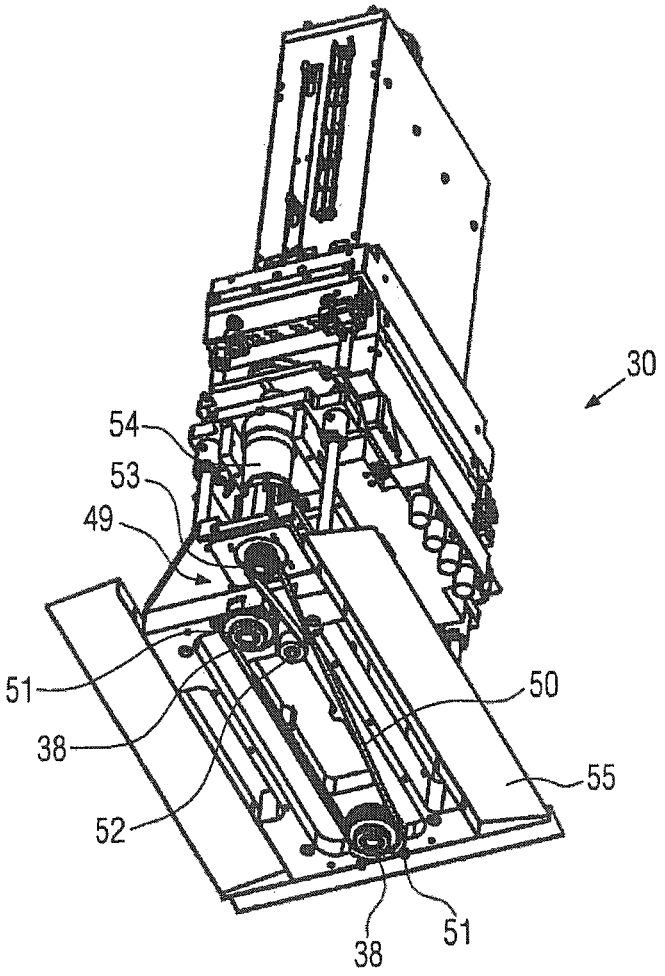
FIG. 4 is bottom perspective view of a belt drive of a lifting gear according to one embodiment of the present invention.

FIG. 4 shows a belt drive 49 of the lifting gear 30 from the bottom. As shown, the belt drive 49 comprises a drive belt 50 which may be designed as a sprocket belt with segmented slots for reducing noise, one belt disk 51 each at the lower ends of the lifting spindles 38, a deflection roller 52 and a driving disk 53. A servomotor 54 oriented in parallel to the lifting spindles 38 and attached to the console 31 drives the belt drive 51 via the driving disk 53 and thus generates the vertical lifting motion H of the tool 32. A cover 55 over the belt drive 51 also provide for a hygienic design of the lifting gear 30 to protect the belt drive 51 from soiling from above. Equally, a chain or another type of belt may be inserted as an alternative.

In the deep-drawing packaging machine according to one embodiment of the invention, the lifting spindles 38 of the lifting gear 30 are, seen from above, arranged outside the collision region K of the tool 32. This means that the lifting spindles 38 are not disposed underneath the tool 32 but, seen with respect to the production direction R, in front of or behind the tool 32 and/or laterally next to the tool 32. The plan view onto the lifting gear 30 is shown in the same direction as the lifting motion of the lifting gear 30, i.e., usually in the vertical direction.

As was already explained, the lifting gear 30 may be provided for the forming station 2, for the sealing station 3 or for the cutting station 4. At the forming station 3, the movable tool 32 would be a mould, usually a lower mould part. At the sealing station 3, the movable tool 32 would be a sealing tool, usually a lower sealing tool part. When the lifting gear 30 is used for the cutting station 4, the tool 32 would be a knife or a counter-knife which is usually held by a support, for example the lifting rail 36. In such a cutting station 4, the knife or the counter-knife to which, as upper tool part 47, a complementary counter-knife or knife is associated, usually has smaller spatial dimensions than the support or the lifting rail 36. Therefore, for the purposes of determining the collision region K, the knife and its support (for example the lifting rail 36) may be commonly considered as "tool (32)" at a cutting station. Thus, the collision region K is the total region which is passed over by the knife and the support during the motion of the lifting gear 30.

At the sealing station 3, the upper tool part 47 may be designed as upper sealing tool part, and no servomotive die unit is provided there.

Designs of the lifting gear 30 which comprise six, eight or more guides 33 and four, six or more lifting spindles are also possible. Moreover, a belt drive 49 is possible where the drive belt 50 runs outside the guides 33 and over four deflection rollers 52 at all four corners of the lifting gear 30 to be able to arrange the lifting rail 36 even closer to the ground.

To permit even longer lifting motions H, the working height of the machine 1 (i.e., the level for the transport of the film 8) and thus the machine frame 6 may be increased.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Deep-drawing packaging machine comprising:

an electromotive lifting gear for at least one of a forming station, a sealing station and a cutting station, wherein the lifting gear comprises:

at least two carriages mounted in vertical guides;

a tool connected to the carriages, the tool being movable in a vertical direction between an uppermost position and a lowermost position, wherein a collision region of the tool is a spatial volume defined by all space that the tool occupies and passes over in a vertical travel distance between the lowermost position and the uppermost position, the spatial volume being bounded by surfaces; and at least two lifting spindles configured to move the tool in the vertical direction between the lowermost position and the uppermost position, each spindle having a vertical axis of rotation such that said at least two spindles are disposed in a parallel relationship to the vertical guides, the at least two lifting spindles, said vertical axes, and said vertical guides being located outside the collision region of the tool and outside said surfaces.

2. Deep-drawing packaging machine according to claim 1, further comprising a lifting rail wherein, said lifting rail is connected to the tool and the carriages.

3. Deep-drawing packaging machine according to claim 1, wherein the lifting spindles are thread rolling spindles.

4. Deep-drawing packaging machine according to claim 1, wherein the lifting spindles are covered by telescopic springs when said tool is positioned at one of an uppermost position, or a lowermost position.

5. Deep-drawing packaging machine according to claim 1, wherein the lifting gear further comprises brakes which may lock the lifting spindles.

6. Deep-drawing packaging machine according to claim 1, wherein the lifting spindles may be driven via a belt drive using an electric motor.

7. Deep-drawing packaging machine according to claim 6, wherein the electric motor is a servomotor.

8. Deep-drawing packaging machine according to claim 6, wherein the belt drive comprises a sprocket belt.

9. Deep-drawing packaging machine according to claim 1, wherein the lifting gear further comprises a fixed connection unit and a movable connection unit for external media.

10. Deep-drawing packaging machine according to claim 9, wherein the movable connection unit is attached to at least one of a lifting rail and the tool.

11. Deep-drawing packaging machine according to claim 9, wherein the fixed connection unit is attached to the lifting gear such that the fixed connection unit cooperates with the movable connection unit in a working position of the tool to connect a medium with the tool using both the fixed connection unit and the movable connection unit.

12. Deep-drawing packaging machine according to claim 9, wherein the fixed connection unit comprises a first contact surface and said moveable connection unit comprises a second contact surface, wherein each of said first and said second contact surfaces are inclined with respect to the vertical direction.

13. Deep-drawing packaging machine according to claim 1, wherein the lifting gear has a stroke of more than 300 mm.

14. Deep-drawing packaging machine according to claim 1, wherein the tool may be positioned, in addition to the upper and lower positions, in a tool change position.

15. Deep-drawing packaging machine according to claim 1, wherein the lifting spindles are each provided between two said guides adjacently in a production direction.

* * * * *